United States Patent [19]

van Daalen

[11] 4,078,282

[45] Mar. 14, 1978

[54] APPARATUS FOR THE REMOVAL OF YARN RESIDUE FROM A BOBBIN OR THE LIKE

[75] Inventor: Peter van Daalen, Hengelo, Netherlands

[73] Assignee: Machinefabriek M. Brouwer & Co. B.V., Hengelo, Netherlands

[21] Appl. No.: 762,989

[22] Filed: Jan. 27, 1977

[30] Foreign Application Priority Data

Feb. 4, 1976 Germany ..... 2604199

[51] Int. Cl.[2] ..... B65H 73/00

[52] U.S. Cl. ..... 28/295

[58] Field of Search ..... 28/19, 295; 26/7, 8 R, 26/8 C, 10 R, 10 C, 11, 12; 30/90.4, 286, 294, 314, 319, DIG. 8

[56] References Cited

U.S. PATENT DOCUMENTS

| | | | |
|---|---|---|---|
| 1,070,751 | 8/1913 | Tower | 28/19 |
| 1,109,949 | 9/1914 | Walsh | 28/19 |
| 2,617,172 | 11/1952 | Henry | 28/19 |
| 2,641,821 | 6/1953 | Sjostrom | 28/19 |

FOREIGN PATENT DOCUMENTS

| | | | |
|---|---|---|---|
| 260,836 | 8/1949 | Switzerland | 26/8 C |
| 1,215,040 | 12/1970 | United Kingdom | 28/295 |

*Primary Examiner*—Robert R. Mackey

*Attorney, Agent, or Firm*—Eyre, Mann, Lucas & Just

[57] ABSTRACT

Apparatus for the removal of yarn residue from a bobbin, cop carrier or the like, comprising a cutting element, supported by a movable support and a sensor, being formed by an elongated finger which is slidable longitudinally in a bore of a holder mounted on the support over a predetermined limited distance.

The free end of the finger converges to a point at said free end and is adapted to bear near the cutting element on the bobbin or the like which is to be cleaned. The sensor is spring biased longitudinally in the direction of said free end.

5 Claims, 4 Drawing Figures

APPARATUS FOR THE REMOVAL OF YARN RESIDUE FROM A BOBBIN OR THE LIKE

BACKGROUND OF THE INVENTION

This invention relates to apparatus for the removal of yarn residue from a bobbin, cop carrier or the like, the apparatus having a cutting element, supported by a movable support, and a sensor, which is movably coupled to said support and has its free end so disposed as to bear, in use, near the cutting element, on the bobbin, cop carrier or the like which is to be cleaned, by removal of yarn residue. Such apparatus is hereinafter referred to as being of the kind specified.

DESCRIPTION OF THE PRIOR ART

Apparatus of this kind is known and disclosed by the German Pat. No. 1,029,305. In the apparatus disclosed in this specification, the sensor comprises a crescent-shaped element which can rotate about the end of an arm which forms the movable support. It has been found that this known device does not meet practical requirements. If irregularities occur on the bobbin, the sensor will rotate against the advance motion of the cutting element which will then damage the surface of the bobbin.

SUMMARY OF THE INVENTION

The invention aims to provide an apparatus of the kind specified by means of which complete removal of the yarn residue is made possible within wide limits, irrespective of the thickness of the yarn residue and irrespective of the shape and dimensions of the bobbins or the like and without the possibility of damage thereto.

According to the invention, there is provided an apparatus for the removal of yarn residue from a bobbin, cop carrier, or the like, the apparatus having a cutting element, supported by a movable support, and a sensor, which is movably coupled to said support and has its free and adapted to bear near the cutting element, on the bobbin or the like which is to be cleaned by removal of yarn residue, the sensor being formed by an elongated finger which is slidable longitudinally over a predetermined limited distance in a bore of a holder mounted on the support, the finger having its free end projecting from said holder and converging to a point at said free end, the sensor being spring biased longitudinally in the direction of its free end.

Advantageously, the cutting element is a rotatably driven cutting knife and the sensor, is pivotable about its longitudinal axis, in said bore in the holder and one end of said bore is closed, first and second helical springs acting between the closed end of the bore and the end of the finger remote from said free end and accommodated within said bore, said springs being arranged one within the other and one being weaker than the other, the arrangement being such that over an initial part of a longitudinal displacement of the finger in said holder toward the closed end of said bore from the limiting position defined by said abutment means, only the weaker spring acts on the finger, while in further such displacement both springs act on the finger.

The support is advantageously formed by an arm, one end of which is hinged to a carriage which can be reciprocatingly driven in the longitudinal direction of the arm.

Advantageously, the sensor converges at its free end into an edge defined between a top surface which forms an angle of a few degrees with respect to the longitudinal axis of the finger and a bottom surface which forms an angle of approximately 20° with the longitudinal axis of the sensor.

SURVEY OF THE DRAWINGS

FIG. 1 is a side view of an embodiment of the apparatus according to the invention, FIG. 2 is a plan view of the apparatus of FIG. 1, FIG. 3*a* is a side view of a sensor employed in this apparatus and FIG. 3*b* is a bottom view of the said sensor.

DESCRIPTION OF A PREFERRED EMBODIMENT

Figure 1:
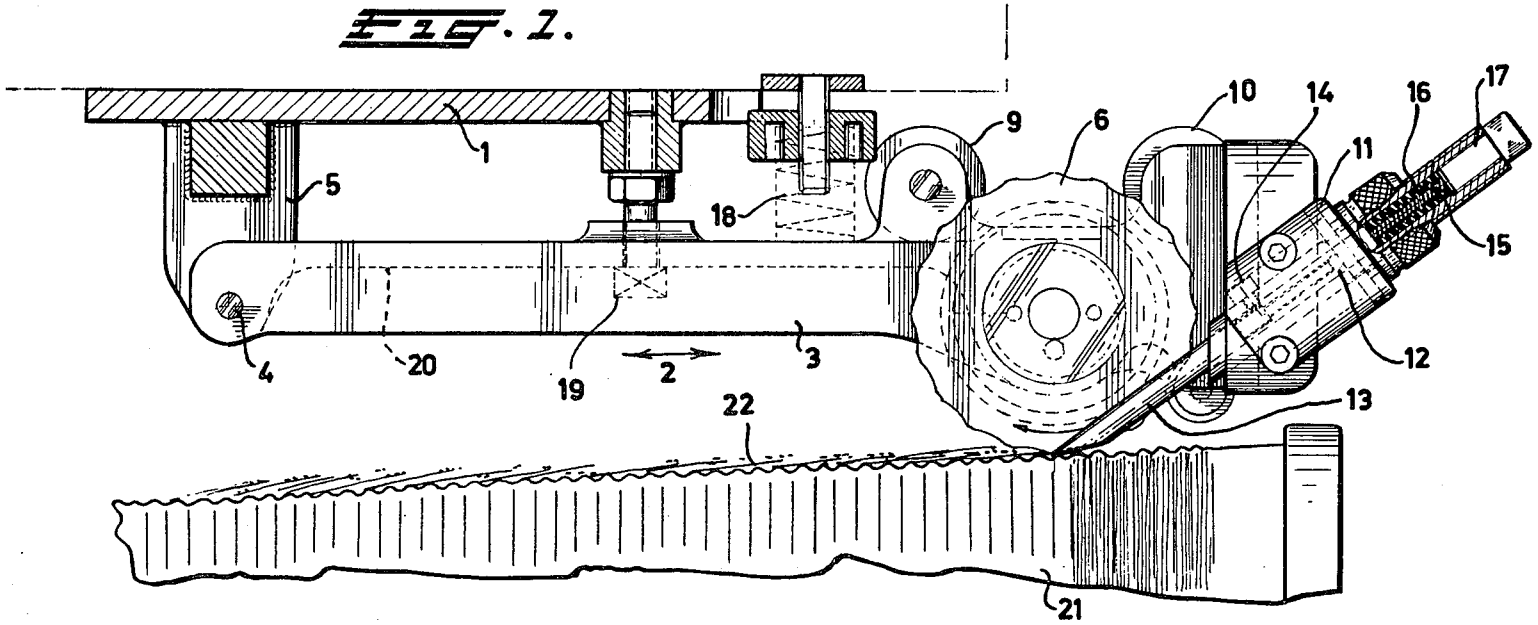
Figure 2:
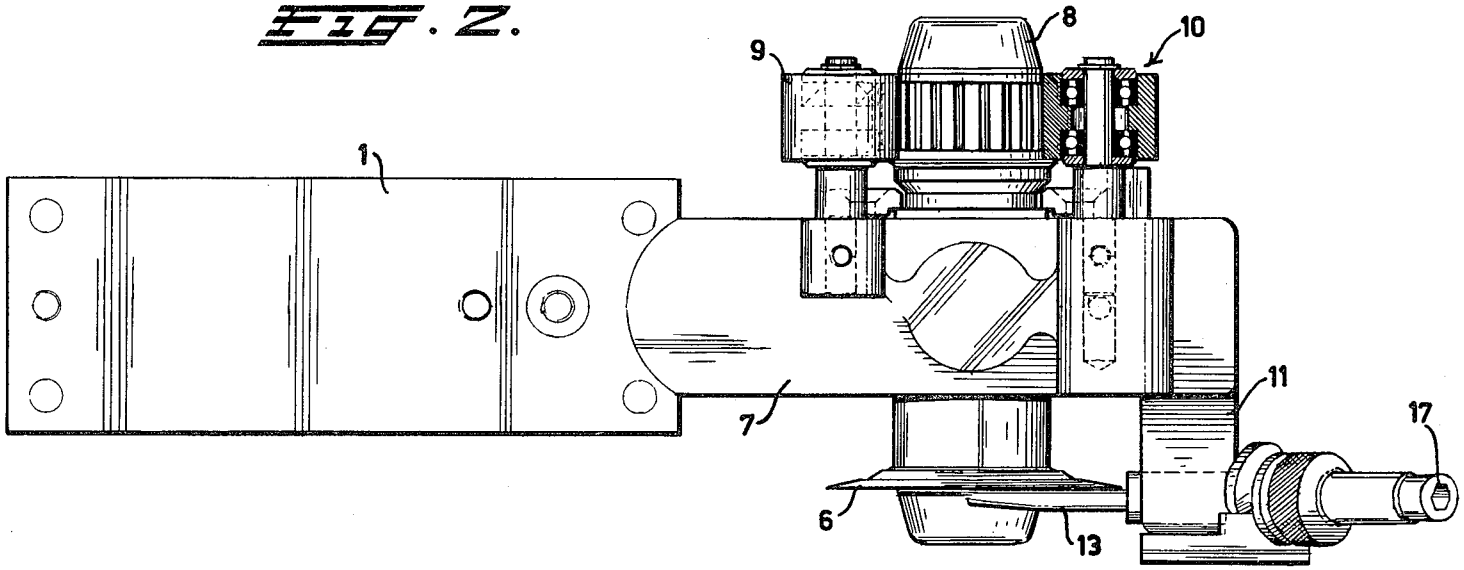

The apparatus illustrated in the drawings comprises a member 1 which is reciprocable linearly with respect to a supporting frame, indicated in broken lines, by drive means (not shown) in opposite directions indicated by arrows 2. An arm 3, extending longitudinally in the direction of the arrows 2, is pivotally connected at one end, via a pivot pin 4 to a flange 5 extending from the underside of the member 1. At the end which is distant from the pivot 4, the arm supports a cutting disc 6, which is rotatably supported in a part 7 of the arm and is coupled to a driving roller 8. Guide rollers 9, 10 for a toothed belt (not shown) for driving the roller 8 and thus the cutting disc 6, are situated on both sides of the said roller 8.

Near the cutting disc, the arm 3 carries a holder 11 with a cylindrical bore 12 therethrough. A sensor 13 in the form of an elongated finger, is fitted in the bore 12, a free end of the finger projecting from a lower end of bore 12 as viewed in FIG. 1. The finger 13 can slide longitudinally in the bore 12 over a predetermined limited distance and can pivot in the bore 12, about its longitudinal axis through a limited angle. The limits of longitudinal and pivotal movement of the finger 13 in the bore 12 are determined by abutment means embodied by the tip of a screw 14 screwed into a threaded bore in the housing 11, transverse to, and intersecting the bore 12, the tip of screw 14 locating in a recess formed in the side of the cylindrical part of the finger which fits in the bore 12, this recess being best shown in FIG. 3*a*. The longitudinal movement of the finger is limited by abutment of the tip of screw 14 with respective longitudinal ends of this recess. The finger 13 is urged downwardly in FIG. 1, i.e. in the direction of its free end by spring means comprising two helical springs, namely a weak spring 15 which is situated within a stronger spring 16. The springs act between the end of the finger 13 within the bore 12 and an end of a screw 17 which is screwed into the upper end of the bore 12 as viewed in FIG. 1 and closes this end of the bore.

The spring 16 is somewhat shorter than spring 15 and is unstressed when the finger 13 is at the limit of its movement out of bore 12. The spring 16 remains unstressed over an initial part of any movement of finger 13 from the last mentioned limit into the bore, until the spring 16 becomes clamped between the screw 17 and the inner end of finger 13, both springs being compressed during subsequent movement of the finger in the same direction.

The arm 3 is under the action of the weak helical spring 18 while the downwardly oriented motion of the arm 3 is limited by the stop bolt 19 which cooperates with the bottom surface 20 of the arm 3.

The frame 1 is reciprocated in the longitudinal direction of the arm 3 over the bobbin which is to be cleaned, for example, the illustrated bobbin 21 with the yarn residue 22. The abutment surface of the sensor 13 follows the surface irregularities of the bobbin, such follow-up action being made possible without adjustment of the arm 3 and of the cutting knife 6 in the vertical direction, namely by the end of the sensor being able to depress the weak spring 15 through a short distance (approximately 0.5 mm) before the end of the sensor comes into contact with the stronger spring 16 which, on being compressed, causes the end of the arm 3 and therefore the knife 6 to be raised. The sensor 13 therefore accurately follows the contours of the bobbin and thus lifts the yarn residue on the bobbin sufficiently far off the said bobbin to permit the yarn residue to be cut through by the cutting knife 6 without the bobbin being damaged.

Figure 3A:
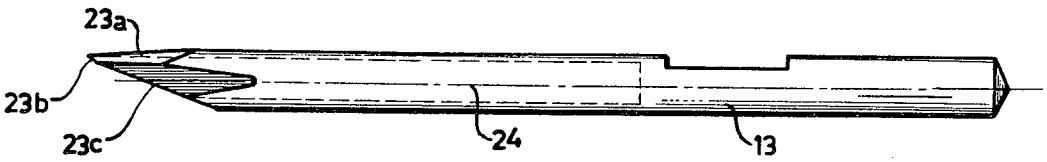
Figure 3B:
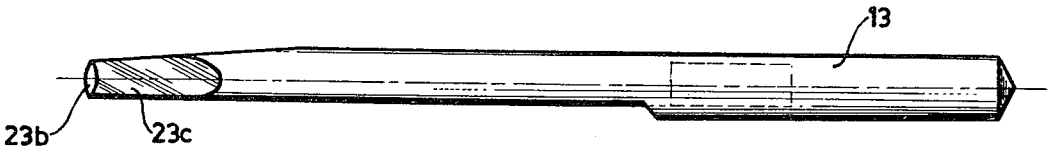

FIGS. 3*a* and 3*b* show the sensor 13 as a side view and as a bottom view. As can be seen from the illustrations, the point is constructed in a special manner, namely with an almost flat top surface 23*a* and a short front surface 23*b* and a bottom surface 23*c* which forms an angle of approximately 20 degrees with the longitudinal axis 24 of the sensor 13.

What I claim is:

1. Apparatus for the removal of yarn residue from a bobbin, cop carrier, or the like, the apparatus comprising a rotating cutting element, a movable support supporting said cutting element, and a sensor, which is movably coupled to said support and has its free end adapted to bear on the surface of said bobbin near the cutting element, on the bobbin or the like which is to be cleaned by removal of yarn residue, a holder having a bore therein mounted on said support, the sensor being formed by an elongated tapering finger in said bore, means for slidably moving said finger longitudinally over a predetermined limited distance in said bore including spring means for urging said finger outward from said holder, the finger having its free end projecting from said holder, said finger converging to a point at said free end, the sensor being spring biased longitudinally in the direction of its free end.

2. The apparatus as defined in claim 1, in which the cutting element is a rotatably driven cutting knife.

3. An apparatus as defined in claim 1 wherein the removable support comprises an arm and a member, a supporting frame, means for permitting linear reciprocation of said member with respect to said supporting frame, pivot means for connecting one end of said arm to said member, means for attaching the cutter and sensor at the other end of said arm, said cutter and sensor extending generally in the direction of linear reciprocation of said member, the axis of said pivot means extending in a direction transverse to the last mentioned direction and to the longitudinal axis of the finger.

4. An apparatus as defined in claim 1 in which the finger converges at its free end to an edge defined between a top surface which forms an angle of a few degrees with respect to the longitudinal axis of the finger and a bottom surface which forms an angle of approximately 20° with respect to the longitudinal axis of the sensor.

5. Apparatus for the removal of yarn residue from a bobbin, cop carrier, or the like, the apparatus comprising a cutting element, supported by a movable support, and a sensor, which is movably coupled to said support and has its free end adapted to bear near the cutting element, on the bobbin or the like which is to be cleaned by removal of yarn residue a holder having a bore therein mounted on said support, the sensor being formed by an elongated finger which is slidable longitudinally in said bore of said holder mounted on the support, the finger having its free end projecting from said holder and converging to a point at said free end, the sensor being spring biased longitudinally in the direction of its free end, said sensor being pivotable about its longitudinal axis in said bore of the holder and in which one end of said bore is closed, abutment means permitting limited longitudinal displacement of said finger in said bore, first and second helical springs acting between the closed end of the bore and the end of the finger remote from said free end and accommodated within said bore, said springs being arranged one within the other and one being weaker than the other, the arrangement being such that over an initial part of a longitudinal displacement of the finger in said holder toward the closed end of said bore from the limiting position defined by said abutment means, only the weaker spring acts on the finger, while in such a further displacement both springs act on the finger.

* * * * *